US005163854A

United States Patent [19]

Licht et al.

[11] Patent Number: 5,163,854

[45] Date of Patent: Nov. 17, 1992

[54] FIELD WIRABLE VME COMPATIBLE EDGE CARD CONNECTOR

[75] Inventors: Harold J. Licht, Johnson City; Gordon R. Potts, Elizabethtown, both of Tenn.

[73] Assignee: Siemens Industrial Automation, Inc., Alpharetta, Ga.

[21] Appl. No.: 810,365

[22] Filed: Dec. 18, 1991

Related U.S. Application Data

[63] Continuation of Ser. No. 538,435, Jun. 8, 1990, abandoned.

[51] Int. Cl.[5] ..... H01R 23/70

[52] U.S. Cl. ..... 439/630; 439/637; 439/59

[58] Field of Search ..... 439/61, 59, 60, 629, 439/636, 630, 632, 637, 717

[56] References Cited

U.S. PATENT DOCUMENTS

| | | | |
|---|---|---|---|
| 2,911,612 | 11/1959 | Jackson et al. | 439/637 |
| 3,474,387 | 10/1969 | Krum et al. | 439/362 |
| 3,573,718 | 4/1971 | Lightner | 439/637 |
| 4,082,407 | 4/1978 | Smorzaniuk et al. | 439/59 |
| 4,239,324 | 12/1980 | Stenz | 439/717 |
| 4,540,232 | 9/1985 | Ziburg | 439/717 |

FOREIGN PATENT DOCUMENTS

| | | | |
|---|---|---|---|
| 0274812 | 9/1964 | Netherlands | 439/637 |

*Primary Examiner*—Larry I. Schwartz
*Assistant Examiner*—Hien D. Vu
*Attorney, Agent, or Firm*—Donald M. Boles

[57] ABSTRACT

A high power density field wireable connector wherein both the wire insertion and the screw tightening mechanism for retaining an inserted wire in the connector are front accessible and negate the requirement to remove the module as in the prior art. The wiring is located toward the interior of the connector rather than the exterior so that the screws are more accessible. The connector housing includes a mechanism for captivating the mounting screws and a two position locator so that various modules already located in the field can use the same connector. Fingers on the circuit board make contact with contact fingers within the connector. Both the fingers on the circuit board and the contact fingers within the connector are preferably plated with gold. A normal spring force on the fingers within the connector is provided by the cantilever action of interior walls of the connector housing with the contact fingers disposed within the housing. The housing is designed with specific dimensions and tolerances both are compatible with both DIN 41612 and VME standards.

12 Claims, 4 Drawing Sheets

FIELD WIRABLE VME COMPATIBLE EDGE CARD CONNECTOR

CROSS-REFERENCE TO RELATED APPLICATION

This is a continuation of Ser. No. 07/538,435 filed on Jun. 8, 1990, and now abandoned.

BACKGROUND OF THE INVENTION

1. Field of the Invention

This invention relates to a front wireable edge connector for use in conjunction with printed circuit boards and the like and, more specifically to a high voltage (up to about 220 volts) front wireable connector mountable on a printed circuit board or printed wiring board surface.

2. Brief Description of the Prior Art

In the prior art, most of the VME and DIN standard cards were low voltage and, accordingly, it was not necessary to provide edge connectors therefore having a high voltage capability. In fact, connectors used in conjunction with VME and DIN cards in the prior art were generally of the pin and socket type. Accordingly, ribbon cable or sub-D type connectors were used.

A prior unsuccessful attempt included wire clamps and screws at right angles to the front of the connector. This posed several problems for a user whereby the user had to remove the connector and disconnect power thereto or remove the module in order to get to the screws, loosen them and replace or remove the wire connected thereto.

SUMMARY OF THE INVENTION

In accordance with the present invention, there is provided a high power density connector wherein both the wire insertion and the screw tightening mechanism for retaining an inserted wire in the connector are front accessible and negate the requirement to remove the module as in the prior art. The wiring is located toward the interior of the connector rather than the exterior so that the screws are more accessible. The connector housing includes a unique mechanism for captivating the mounting screws and a two position locator so that various modules already located in the field can use the same connector. Fingers on the circuit board make contact with contact fingers within the connector as will be described in detail hereinbelow. Both the fingers on the circuit board and the contact fingers within the connector are preferably plated with gold. A normal spring force on the fingers within the connector is provided by the cantilever action of interior walls of the connector housing with the contact fingers disposed within the housing.

DESCRIPTION OF THE PREFERRED EMBODIMENT

Figure 1:
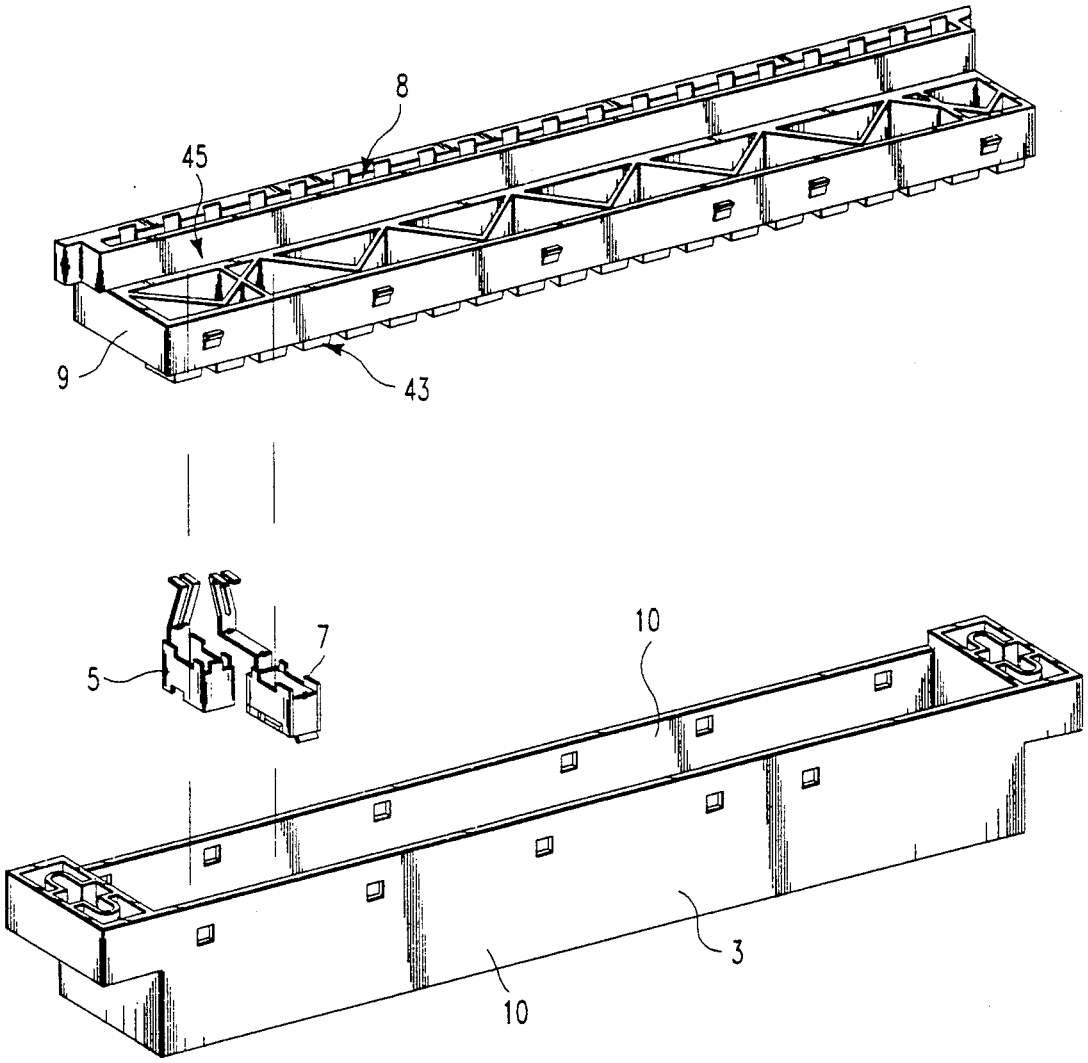
FIG. 1 is an exploded view of an edge card connector in accordance with the present invention.

Referring to FIG. 1, there is shown an exploded view of the edge connector 1 in accordance with the present invention. The connector 1 includes a housing having a base portion 3 in which are contained contact elements of two different types denoted as 5 and 7 which are disposed in insulated cavities in the bottom portion and a top portion 9. The base portion 3 and top portion 9 are secured together in standard manner, such as with snaps so that the outer edges of the face 43 of the top portion 9 rest inside of the side wall 10 of the bottom portion 3 as shown in FIG. 1. A printed circuit board is insertable into the groove 8 in the top portion 9, the contact elements 5 being biased against one surface of the board and the contact elements 7 being biased against the opposing surface of the board as will be explained hereinbelow.

Figure 2:
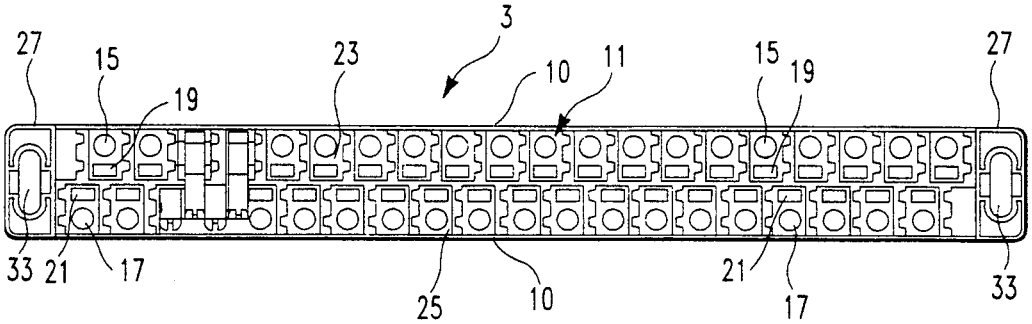
FIG. 2 is a view of the bottom wall or face portion of the housing as viewed from the interior of the housing.
Figure 3:
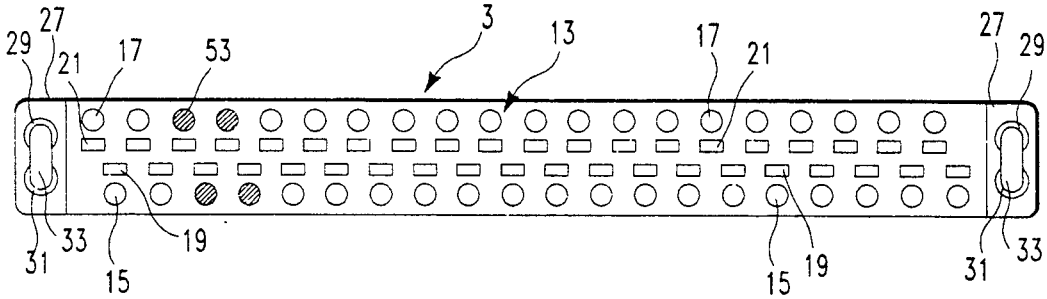
FIG. 3 is a view of the bottom wall or face portion of the housing as viewed from the exterior of the housing.

Referring now to FIGS. 2 and 3, there are shown end views of the two sides of the bottom exterior wall of the base portion 3, this wall including faces 11 and 13 of the bottom exterior wall of the base portion 3, the face 11 shown in FIG. 2 being the face seen when looking downwardly into the interior of the base portion 3 as shown in FIG. 1 and the face 13 shown in FIG. 3 being the face seen when looking from the exterior of the base portion 3. The base bottom portion 3 also includes side walls 10 extending upwardly from the bottom portion face 11. The base portion 3 is formed of a rigid material which has good electrical insulating properties, preferably a polyester such as General Electric Valox DR-48 Black.

The faces 11 and 13 both includes at the surfaces thereof a plurality of circular apertures 15 and 17 extending therebetween the apertures 15 being offset from the apertures 17, in separate rows and interleaved.

Within the face 13 are a plurality of rectangular apertures 19 and 21 which are disposed adjacent the apertures 15 and 17 respectively and which extend from the face 11 to the face 13 as shown in FIGS. 2 and 3. The interiors of each of the apertures 19 and 21 are bevelled outwardly in the direction of the face 13 to permit easy entry of wires therein without fraying, particularly in the case of multiple strand wires. The axes of the apertures 15 and 17 are at about a five degree angle with respect to a line perpendicular to the plane of the face 13 to provide easier access to screw heads 53 of screws to be located within these apertures 15 and 17.

The face 11 includes a plurality of partitioned rectangular cavities formed by walls surrounding each aperture pair 15, 19 and each aperture pair 17, 21. These cavities are shown in an upper cavity row 23 and in a lower cavity row 25 which is offset from the upper cavity row. The side walls of the cavities 23 and 25 terminate within the base portion 3.

The base portion 3 also includes a flange element 27 at each end thereof which is secured to the side walls 10 for receiving screws or the like for fastening the base portion to a support (not shown). The flange element includes a pair of circular depressions 29 and 31 in the face 13 for receiving a screw head therein and a groove 33 which permits movement of a screw body portion therethrough when the head is not in a depression 29 or 31 for alignment of the base portion with a support on which the connector will be mounted, if necessary.

Figure 6:
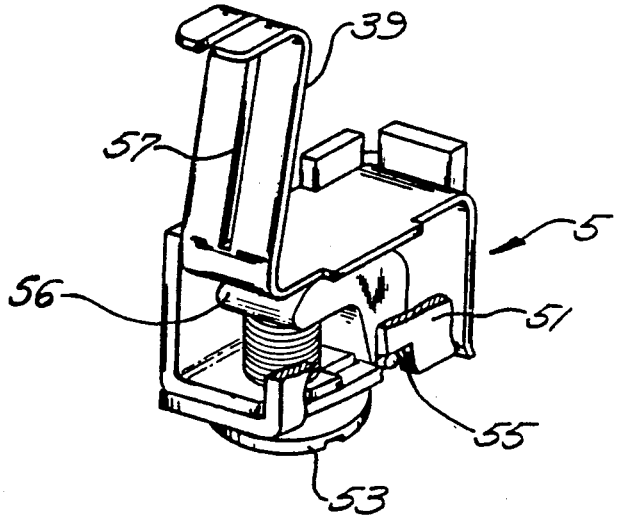
FIG. 6 is an enlarged, partially cut away view of the contact element 5 of FIG. 1.
Figure 7:
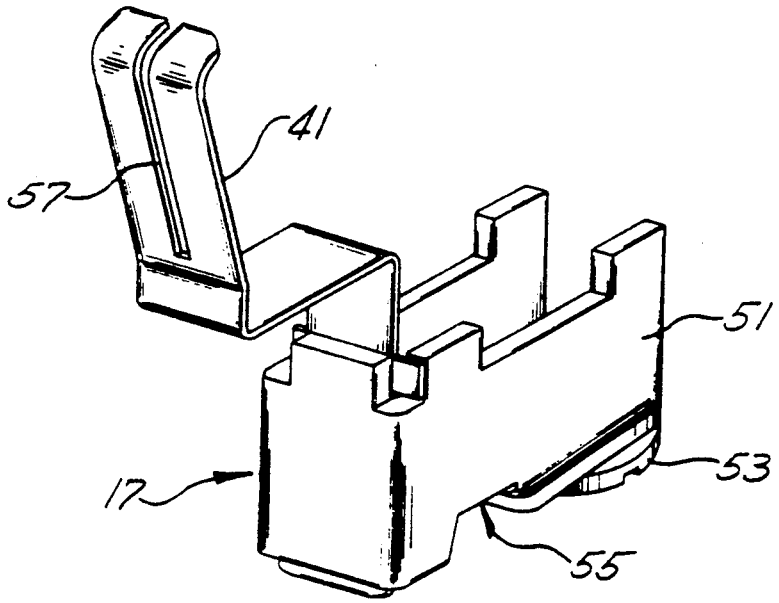
FIG. 7 is an enlarged view of the contact element 7 of FIG. 1.

Contact elements 5 as shown in FIGS. 1 and 6 are disposed within the cavities 23 and contact elements 7 as shown in FIGS. 1 and 7 are disposed within the cavities 25. The contact elements 5 each have a substantially linear resilient finger 39 extending outwardly from one of the cavities 23 and the contact elements 7 each have a somewhat Z-shaped resilient finger 41 extending outwardly from one of the cavities 25. The fingers 39 and 41 are spaced apart when disposed in their respective cavities so that a printed circuit board can be positioned therebetween with the fingers 39 on one surface of the board and biased thereagainst and the fingers 41 on the opposite surface of the board and biased thereagainst. The structure of the contact elements 35 and 37 will be discussed in more detail hereinbelow with reference to FIGS. 6 and 7.

Figure 4:
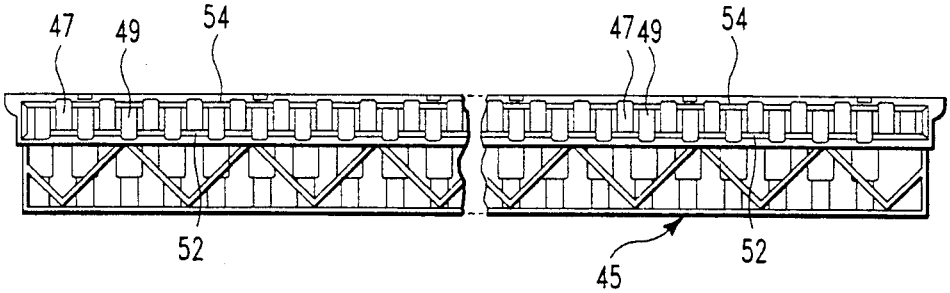
FIG. 4 is a view of the top wall or face portion of the housing as viewed from the exterior of the housing.
Figure 5:
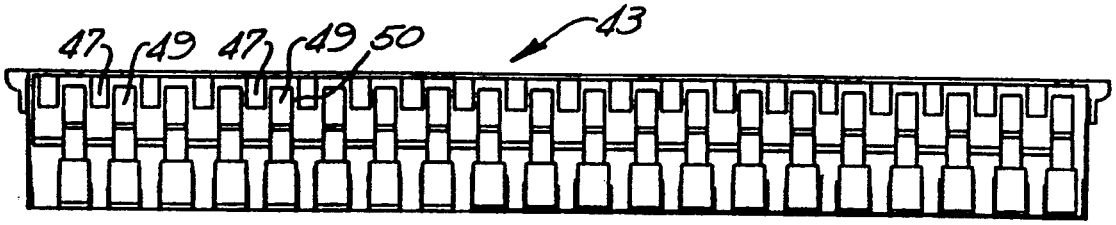
FIG. 5 is a view of the top wall or face portion of the housing as viewed from the interior of the housing.

Referring now to FIGS. 4 and 5, there are shown end views of the two opposing major sides or faces of the top portion 9, including faces 43 and 45 of the bottom exterior wall of the top portion 9, the face 45 being shown in FIG. 4 and the face 43 being shown in FIGS. 1 and 5. The top portion 9 is formed of a rigid material which has good electrical insulating properties, preferably a polyester, such as General Electric Valox DR-48 BLack.

The face 43 as shown in FIG. 5 includes an upper row of apertures 47 interleaved with a lower row of apertures 49. The face 43 is positioned above and spaced from the face 11 of the bottom portion 3 with the contact elements 5 disposed in the upper row of apertures 47 and the contact elements 7 disposed in the lower row of apertures 49. The apertures 47 and 49 are electrically insulated from each other by the aperture walls 50 therebetween. The axes of the cavities formed by the side walls 23 and 25 of the base portion 3 are coaxial with the axes of the apertures 47 and 49.

The face 45 as shown in FIG. 4 includes the other end of each of the apertures 47 and 49. It will be noted that the apertures 47 and 49 are alternating and that the apertures 47 include a step 52 on the interior surface thereof whereas the apertures 49 include a step 54 on the exterior surface thereof. This arrangement causes the contact elements 5 to be positioned along the exterior surfaces of their associated apertures 47 and causes the contact elements 7 to be positioned along the interior surfaces of their associated apertures 49. In this way, the contact elements 5 and the contact elements 7 are positioned in separate spaced apart parallel planes and leave room for a printed circuit board or the like to be positioned between the planes of contact elements.

Referring now to FIG. 6 and, there is shown a perspective view of a contact element 5. The contact element 5 includes a housing portion 51 with a threaded region having a threaded screw 53 therein and a wire receiving opening 55 to be aligned with one of the rectangular apertures 19. Also secured to the housing portion 51 is the finger 39 of the contact element 5 which is shown to have a split portion 57 at its terminus to provide additional resiliency. Rotation of the screw 53 causes rotation of a cam 56 within the housing 51 whereby, with a wire (not shown) inserted in the opening 55, the cam will rotate and lock the wire within the opening. The screw 53 is disposed in one of the circular apertures 15 in the housing portion 3 and is therefore accessible from the exterior of the connector housing as is the wire receiving aperture 19. A wire will be fed into a square aperture 19 associated with the circular aperture 15 for the same contact element and the screw 53 will then be rotated to lock the wire within the opening 55. It can be seen that both wire feed and wire tightening or loosening are accomplished from the same exterior surface of the connector.

Referring now to FIG. 7, there is shown a perspective view of a contact element 7. The contact element 7 is identical to the contact element 5 except that the finger 41 thereof has a Z-shape.

The connector in accordance with the present invention is fabricated by positioning the appropriate contact elements 5 and 7 into the cavities 23 and 25 respectively of the bottom portion 3. The top portion 3 is then brought in contact with the bottom portion 5 as discussed above with the fingers 39 and 41 of the contact elements disposed in the apertures 47 and 49 of the top portion 5, the fingers 39 being disposed in the aperture 8 (FIG. 1) in the grooves on the outer surface thereof and the fingers 41 being disposed in the aperture 8 in the grooves therein (not shown in FIG. 1) on the inner surface thereof. A printed circuit board can then be inserted into the groove 8 whereby the fingers 39 will be biased against one surface thereof and the fingers 41 will be biased against an opposing surface thereof. Insertion and securing of wires to the connector 1 is accomplished by insertion of a wire into an aperture 19 or 21 into the face 13 as shown in FIG. 2 with the screw head 53 then being rotated to cause rotation of a cam against the wire and consequent locking of the wire within the connector housing.

Though the invention has been described with respect to a preferred embodiment thereof, many variations and modifications will immediately become apparent to those skilled in the art. It is therefore the intention that the appended claims be interpreted as broadly as possible in view of the prior art to include all such variations and modifications.

We claim:

1. An edge card connector comprising:

a housing member having a groove therein oriented along a plane for insertion of an edge card tab therein in a first insertion direction;

a plurality of first cavities defined by the housing and oriented generally parallel to the plane and each other and which are electrically isolated from each other for receipt of wires therein in a second insertion direction opposite and generally parallel to the first insertion direction; and a contact member disposed within at least one of the first cavities and having a contact finger extending into the groove for electrical engagement with an edge card tab contact, an aperture in the housing and extending in the second insertion direction and adjacent the contact member, a wire receiving opening in the contact member oriented so as to align a wire inserted therein generally parallel to the plane and in electrical contact with the contact member, wherein the contact member has a selectively actuable biasing member offset from the wire receiving opening, for selectively retaining and releasing a wire inserted into the wire receiving opening, wherein the housing member is further configured such that access to the biasing member is parallel to the plane and in the second insertion direction.

2. A device according to claim 1 the access to the biasing member is accomplished by a tool receiving opening disposed in the housing member.

3. A device according to claim 2 wherein the tool receiving opening is disposed in the housing such that actuation of the biasing member may only be accomplished by a tool oriented generally parallel to the plane in the second insertion direction.

4. A device according to claim 1 wherein the housing member has a fastening means attached thereto for fixedly securing the housing member to an edge card.

5. A device according to claim 4 further comprising an enclosure having an opening therein;

an edge card disposed in the enclosure, the edge card having the edge card tab thereon and having the edge card tab adjacent the opening in the enclosure, wherein the fastening means coacts with the enclosure so as to fixedly secure and retain the edge card in the enclosure.

6. An edge card connector comprising:

a housing member having first and second opposite sides, a groove defined by the first side that is oriented along a plane for insertion of an edge card tab therein in a first insertion direction;

a plurality of first cavities defined by the housing along the first side which are electrically isolated from each other for receipt of wires therein in a second insertion direction opposite the first insertion direction; and a contact member disposed within at least one of the first cavities having a contact finger extending into the groove for electrical engagement with an edge card tab contact, an aperture in the second side and adjacent the contact member and a selectively actuable biasing member for selectively retaining and releasing a wire inserted into a wire receiving opening of the contact member, wherein access to the biasing member is via a tool receiving opening in the second side, generally parallel to the plane and offset from the wire receiving opening.

7. A device according to claim 6 wherein the tool receiving opening is disposed in the housing such that actuation of the biasing member may only be accomplished by a tool oriented generally parallel to the plane in the second insertion direction.

8. A device according to claim 6 wherein the housing member has a fastening means attached thereto for fixedly securing the housing member to an edge card.

9. A device according to claim 8 further comprising an enclosure having an opening therein;

an edge card disposed in the enclosure, the edge card having the edge card tab thereon and having the edge card tab adjacent the opening in the enclosure, wherein the fastening means coacts with the enclosure so as to fixedly secure and retain the edge card in the enclosure.

10. An edge card connector comprising:

a housing member having first and second opposite sides; a groove with a pair of opposed sidewalls defined by the first side, the groove oriented along a plane for insertion of an edge card tab therein in a first insertion direction; a plurality of first cavities defined by the housing along the first side and extending to the second side, oriented in at least two rows that are generally parallel to the plane and each other and which are electrically isolated from each other for receipt of wires therein in a second insertion direction opposite and generally parallel to the first insertion direction; and a contact member disposed within a plurality of the first cavities having:

a contact finger extending into the groove for electrical engagement with an edge card tab, the contact fingers oriented so that contact members inserted in a first of the plurality of first cavities are proximal the groove and one of the pairs of first sidewalls and contact members inserted in at least the second of the two pluralities of first cavities proximal the groove and the second of the pair of sidewalls;

an aperture in the second side adjacent the contact member and oriented to align a wire inserted therein generally parallel to the plane, and a selectively actuable biasing member co-acting with the contact member for electively retaining and releasing a wire inserted into a wire receiving opening of the contact member, wherein actuation of the biasing member is accomplished by a tool oriented generally parallel to the plane and offset from the wire receiving opening.

11. A device according to claim 10 wherein the housing member has a fastening means attached thereto for fixedly securing the housing member to an edge card.

12. A device according to claim 11 further comprising an enclosure having an opening therein;

an edge card disposed in the enclosure, the edge card having the edge card tab thereon and having the edge card tab adjacent the opening in the enclosure, wherein the fastening means coacts with the enclosure so as to fixedly secure and retain the edge card in the enclosure.

* * * * *